US006595457B2

(12) United States Patent
Sturm

(10) Patent No.: US 6,595,457 B2
(45) Date of Patent: Jul. 22, 2003

(54) DEVICE FOR CONTROLLING A CREEL OF A TEXTILE MACHINE

(75) Inventor: Christian Sturm, Krefeld (DE)

(73) Assignee: W. Schlafhorst AG & Co. (DE)

( * ) Notice: Subject to any disclaimer, the term of this patent is extended or adjusted under 35 U.S.C. 154(b) by 0 days.

(21) Appl. No.: 09/954,347

(22) Filed: Sep. 17, 2001

(65) Prior Publication Data

US 2002/0033430 A1 Mar. 21, 2002

(30) Foreign Application Priority Data

Sep. 16, 2000 (DE) ..... 100 45 919

(51) Int. Cl.[7] ..... B65H 54/52
(52) U.S. Cl. ..... 242/486.4; 242/485.8
(58) Field of Search ..... 242/486.4, 486.3, 242/486.6, 486.7, 421.9, 596.8, 477.4, 485.8

(56) References Cited

U.S. PATENT DOCUMENTS 4,120,462 A * 10/1978 Raasch et al. ..... 242/486.4 X
5,112,000 A * 5/1992 Derichs et al. ..... 242/486.4
5,639,036 A 6/1997 Flamm
5,697,565 A 12/1997 Zitzen
6,135,383 A 10/2000 Flamm et al.
6,206,320 B1 * 3/2001 Kusters et al. ..... 242/477.4
6,405,967 B1 * 6/2002 Sturm et al. ..... 242/485.3
6,405,968 B2 * 6/2002 Flamm et al. ..... 242/486.4

FOREIGN PATENT DOCUMENTS

DE 195 27 214 A1 1/1997
DE 195 34 333 A1 3/1997
DE 198 17 363 A1 10/1999

OTHER PUBLICATIONS

German Search Report

* cited by examiner

*Primary Examiner*—Michael R. Mansen
*Assistant Examiner*—Minh-Chau Pham
(74) *Attorney, Agent, or Firm*—Kennedy Covington Lobdell & Hickman, LLP

(57) ABSTRACT

A device for controlling a creel (12) of a textile machine, which is supported to be pivotable to a limited degree by a pivot shaft (14) via a defined torque generated by a torque generator (24, 28, 30) controlled by a drive mechanism (34). The torque generator (24, 28, 30) is connected with the creel (12) by means of a reduction gear arrangement (20, 22; 60, 62).

5 Claims, 2 Drawing Sheets

DEVICE FOR CONTROLLING A CREEL OF A TEXTILE MACHINE

CROSS-REFERENCES TO RELATED APPLICATIONS

This application claims the benefit of German patent application DEP10045919.6, filed Sep. 16, 2000, herein incorporated by reference.

FIELD OF THE INVENTION

The present invention relates generally to a device for controlling a creel of a textile machine and, more particularly, to a device for controlling a creel which is pivotable to a limited degree and can be loaded with a defined torque by a torque generator which is controlled by a drive mechanism.

BACKGROUND OF THE INVENTION

A device of the described type for controlling a creel of a textile machine is described in German Patent Publication DE 198 17 363 A1, for example.

With this known device, a bobbin held in a creel is driven by a roller by means of friction. It is intended in this device to provide an exactly predetermined bobbin contact pressure between the driving roller and the bobbin, which can be controlled in order to be able, for example, to set a defined slippage between the bobbin and the roller.

Therefore the creel is supported by means of a pivot shaft to be pivotable to a limited degree thereabout, with a connecting disk being fixedly connected with the pivot shaft against relative rotation.

In addition, the connecting disk is connected by means of helical springs with a gear wheel such that rotation of the gear wheel by means of a drive motor, in particular a step motor, generates a torque acting on the connecting disk and therefore on the pivot shaft. In order to be able to introduce a sufficiently large torque into the pivot shaft, a total of six helical springs, which are arranged tangentially in respect to the pivot shaft, are provided between the gear wheel and the connecting disk.

SUMMARY OF THE INVENTION

In view of the above mentioned state of the art, an object of the present invention is to provide a device for the defined control of a creel, which is particularly effective and at the same time cost-effective and simple in construction.

In accordance with the present invention, this object is addressed in a creel of the aforedescribed type by providing a reduction gear arrangement for connecting the torque generator with the creel.

By the employment of a reduction gear arrangement, it is possible to utilize a torque generator which is relatively low-powered and simply. The high torque required for the defined control of the creel is nevertheless assuredly provided.

In a preferred embodiment, the torque generator advantageously has a flat coil spring.

By using a flat coil spring it is possible to achieve a very simple, cost-effective construction of the entire device. For this purpose, one end of the flat coil spring is fastened on a first element of the torque generator, which is displaced by a drive element. The other end of the flat coil spring is connected with a second element, which is coupled with a gear. The flat coil spring generates a defined force by the rotation of the first element in respect to the second element, and this force is converted into torque. Advantageously, this defined force can be adjusted within wide margins since the flat coil spring can be rotated over a large angle because of its type of construction.

In an advantageous embodiment of the invention, the gear arrangement is embodied as a ribbon gear. A generation of the torque free of play at the pivot shaft can be achieved with the aid of a ribbon gear. This is advantageous in promoting the exact control of the creel, and therefore in promoting an exactly set bobbin contact pressure.

In an alternative embodiment, the torque generator can also be directly connected with a driveshaft of the drive element, which results in a direct control of the torque generator by means of the drive element. The number of required components is reduced by this arrangement.

It is further preferred in an advantageous embodiment of the present invention that another gear arrangement is arranged between the drive element and the torque generator. Thus, the torque generator is arranged between two gears, or between two gear arrangements, which results in an extremely flexible design of the device in accordance with the invention. For example, a low-powered and cost-effective step motor can be used as the drive motor.

Further characteristics and advantages of the present invention will be described and understood from the following description together with the accompanying drawings.

DETAILED DESCRIPTION OF THE PREFERRED EMBODIMENTS

Figure 1:
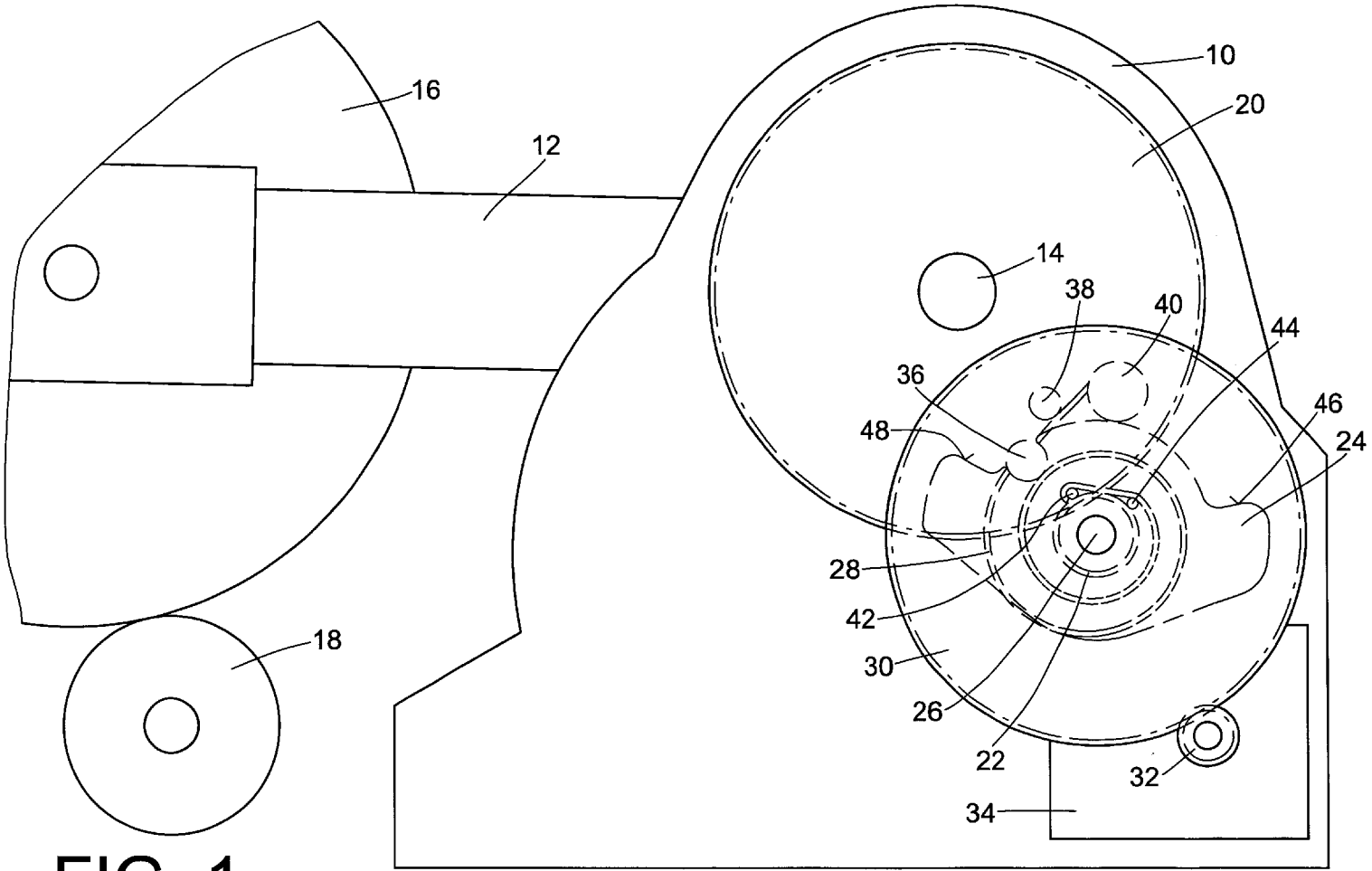
FIG. 1 schematically represents a lateral view of a device in accordance with the present invention for controlling a creel in accordance with a first embodiment of the invention.
Figure 2:
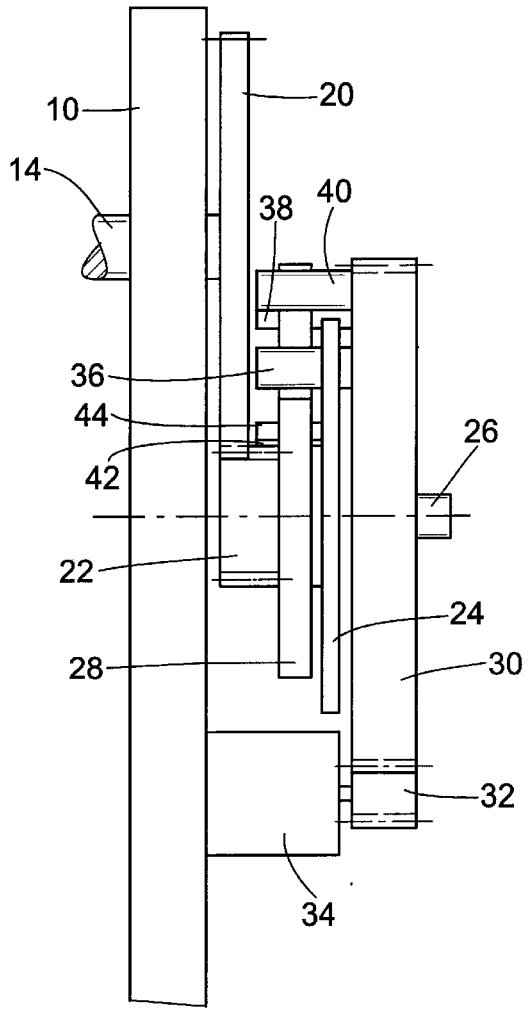
FIG. 2 is a schematic front view of the device in FIG. 1.

A winding head housing 10 of a textile machine is shown in the schematic representations in FIGS. 1 and 2, on which a creel 12 is supported by means of a pivot shaft 14 to be pivotable in a limited manner. A bobbin 16 is rotatably seated in the creel 12 and is driven by frictional force from surface contact with a drive roller 18. In order to provide a predefined contact pressure of the bobbin 16 on the roller 18, a defined, adjustable torque is applied to the pivot shaft 14 of the creel 12, the torque, as a rule, being set to reduce the load on the creel 12.

Such a predefined even contact pressure is very important in connection with producing cheese-type bobbins, since otherwise not only the outer appearance of the bobbins, but also their unwinding behavior, are negatively affected.

However, in areas of pattern disruption, the introduction of a defined slippage between the bobbin 16 and the roller 18 is desirable, for which purpose the torque acting on the creel 12 is increased, thereby definitively reducing the contact pressure of the bobbin 16 on the roller 18.

As represented in the drawings, one end of the pivot shaft 14 is fixed with the creel 12 against relative rotation, and the other end of the pivot shaft 14 is fixed against relative rotation with a gear wheel 20 of a reduction gear arrangement. The gear wheel 20 meshes with a pinion 22, which is fixedly connected against relative rotation with a stop plate 24 and is rotatably seated on an axle stub 26.

In turn, the axle stub 26 is fastened on the winding head housing 10 of the textile machine. A flat coil spring 28 is fastened with one of its ends on the stop plate 24, and its other end is connected with an adjustment gear wheel 30, which meshes with a motor pinion 32 of an electric step motor 34.

The flat coil spring 28 is fastened on the adjustment gear wheel 30 with the aid of three fastening bolts 36, 38, 40, for example. One end of the flat coil spring 28 is clamped between the bolts 36, 38, 40 for this purpose, and is fixed in this position by its inherent prestress. The other end of the flat coil spring 28 is fastened on the stop plate 24 with two bolts 42 and 44.

If the adjustment gear wheel 30 is rotated with respect to the stop plate 24, the flat coil spring 28 is stressed or relaxed, and, as a result, it generates a force acting on the stop plate 24, which is converted to a torque acting on the creel 12 via the pinion 22, the gear wheel 20 and the pivot shaft 14.

A relative rotation between the adjustment gear wheel 30 and the stop plate 24 is limited by the bolt 40, so that two end positions of the stop plate 24 are defined. A first end position is defined by the abutment of a first edge 46 of a first radially extending protrusion of the stop plate 24 against the bolt 40. A second end position is defined by the abutment against the bolt 40 of a second edge 48 of a second protrusion of the stop plate, which extends radially outwardly relative to the axle stub 26 opposite to the first protrusion. The force, which can be minimally or maximally generated by the flat coil spring 28, and the resultant minimum, or maximum, torque, are fixed by these two end positions.

In order to control the creel 12, and therefore the contact pressure of the bobbin 16 on the roller 18, the motor pinion 32 is displaced by the step motor 34 by a defined number of rotational steps in a desired direction. This rotation of the pinion 32 causes a rotation of the adjustment gear wheel 30, and therefore the stressing or relaxation of the flat coil spring 28. The force generated by the flat coil spring 28 changes because of the stressing or relaxation of the flat coil spring 28 and is transmitted via the bolts 42, 44 to the stop plate 24 and the pinion 22 which is fixedly connected therewith against relative rotation. The force generated by the flat coil spring 28 is converted into a torque by the pinion 22, which meshes with the larger gear wheel 20 and thereby applies the torque to the pivot shaft 14 to decrease or increase the contact pressure of the bobbin 16 on the roller 18.

Because the pinion 22 and the gear wheel 20 constitute a reduction gear arrangement, a relatively weak force of the flat coil spring 28 suffices for generating a relatively large torque at the pivot shaft 14. Therefore the flat coil spring 28 can be designed to be comparatively weak and cost-effective.

In an alternative embodiment, the torque generator may be arranged in the area of a second reduction gear arrangement comprised of the motor pinion 32 and the adjustment gear wheel 30. It is possible in this manner to generate a large torque at the pivot shaft 14 even with a weak and cost-effective step motor 34. However, the required stressing of the flat coil spring 28 can only be achieved by tolerating a relatively large displacement track in this case.

For providing a clearer representation, the creel 12, the bobbin 16 and the roller 18 are not represented in FIG. 2.

As can be seen from the representation in FIG. 2, a torque generator is constituted in this embodiment by the adjustment gear wheel 30 with the bolts 36, 38 and 40, the flat coil spring 28, the stop plate 24 with the bolts 42 and 44, and the pinion 22.

Figure 3:
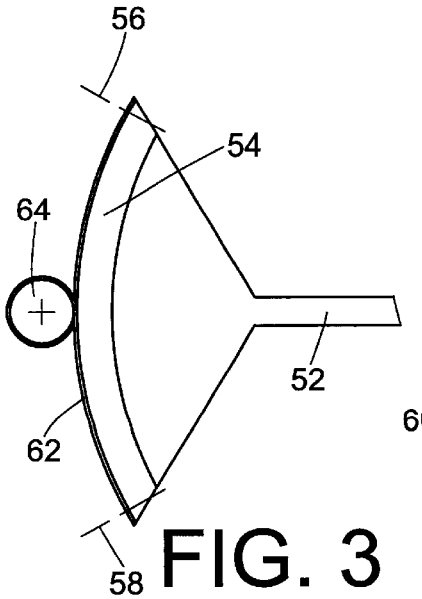
FIG. 3 is a lateral view of a ribbon drive in accordance with a second embodiment of the invention.
Figure 4:
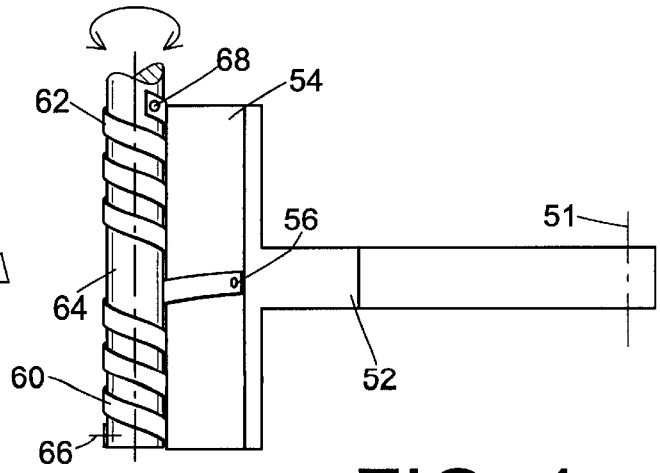
FIG. 4 is a top view of a ribbon drive in accordance with FIG. 3.

FIGS. 3 and 4 schematically show a further embodiment of the invention wherein a ribbon drive is employed. Here, a pivot shaft 51 is only indicated by a broken line in FIG. 4.

A transfer lever 52 is fixedly connected with the pivot shaft 51 against relative rotation and has a cylindrical section 54 which is centered in respect to the pivot shaft 51. Ribbons 60 and 62 are respectively fastened at the attachment points 56 and 58 of the cylindrical section 54. The ribbons 60 and 62, which are preferably made of steel, extend from the cylindrical section 54 to and are spirally wound on a driveshaft 64, which is connected with a torque generator.

The ribbon attachment points 56 and 58 on the cylinder section 54 are located on opposite sides relative to the driveshaft 64, and the respective ribbons 60, 62 extend in opposite directions spirally about the drive shaft to respective attachment point 66, 68 at which the ribbons 60, 62, are fastened to the drive shaft 64.

Thus, rotation of the driveshaft 64 causes a winding and unwinding movement of the ribbons 60, 62, which is converted into a pivoting movement of the transfer lever 52, and therefore of the creel.

To the greatest extent the ribbon drive represented in FIGS. 3 and 4 operates without play and hysteresis.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. In a device for controlling a creel of a textile machine, wherein the creel is supported by a pivot shaft for a limited degree of pivoting movement via application to the pivot shaft of a defined torque generated by a torque generator driven by a drive mechanism, the improvement wherein the torque generator is connected with the creel by a reduction gear arrangement.

2. The device in accordance with claim 1, characterized in that the torque generator includes a flat coil spring.

3. The device in accordance with claim 1, characterized in that the gear arrangement comprises a ribbon gear arrangement.

4. The device in accordance with claim 1, characterized in that the torque generator is connected with a drive shaft of the drive mechanism.

5. The device in accordance with claim 1, characterized in that another gear arrangement is arranged between the drive mechanism and the torque generator.

* * * * *